United States Patent [19]

Reed

[11] 4,217,088

[45] Aug. 12, 1980

[54] BURNER FOR VERY LOW PRESSURE GASES

[75] Inventor: Robert D. Reed, Tulsa, Okla.

[73] Assignee: John Zink Company, Tulsa, Okla.

[21] Appl. No.: 781,846

[22] Filed: Mar. 28, 1977

[51] Int. Cl.[2] ..... F23C 5/08; F23C 7/02

[52] U.S. Cl. ..... 431/181; 431/5; 431/163; 431/190

[58] Field of Search ..... 431/190, 5, 202, 4, 431/163, 187, 188, 181; 239/425

[56] References Cited

U.S. PATENT DOCUMENTS

| | | | |
|---|---|---|---|
| 1,731,306 | 10/1929 | Hileman | 239/425 X |
| 2,935,128 | 5/1960 | Ferguson | 239/425 X |
| 3,093,314 | 6/1963 | Meyer | 239/425 X |
| 3,267,927 | 8/1966 | Hirschberg | 239/425 X |
| 3,832,121 | 8/1974 | Metz et al. | 239/425 X |
| 3,840,320 | 10/1974 | Desty et al. | 431/5 X |
| 3,963,182 | 6/1976 | Rulseh | 239/425 X |
| 3,973,899 | 8/1976 | Reed et al. | 431/5 X |
| 3,994,671 | 11/1976 | Straitz | 431/5 X |
| 4,025,282 | 5/1977 | Reed et al. | 431/4 X |

*Primary Examiner*—Irwin C. Cohen
*Attorney, Agent, or Firm*—Head & Johnson

[57] ABSTRACT

Apparatus for burning combustible gases at very low pressure, in combination with a combustion chamber having an opening through one wall. The burner system comprises a burner tube for supplying the low pressure gas, comprising a tube of selected diameter and length, with an annular flange extending inwardly at the end inserted into the opening in the wall. A steam tube of smaller diameter than the burner tube, is mounted axially inside of the burner tube, and has a closed end in the plane of the inwardly extending flange. A plurality of orifices are drilled through the closed end of the steam tube at a selected angle to the axis, whereby when steam is supplied to the steam tube, at 5# gauge or more, high velocity jets of steam will flow outwardly through the orifices along the surface of a cone, and will aspirate into the steam streams the low pressure gas, which will be mixed with the steam, and will flow as a conical wall of steam and gas. This high velocity flow will aspirate air into the steam-gas streams for provision of air for burning the gas fuel completely.

1 Claim, 3 Drawing Figures

BURNER FOR VERY LOW PRESSURE GASES

BACKGROUND OF THE INVENTION

1. Field of the Invention

This invention lies in the field of the combustion of low pressure gases for recovery of their heat value.

More particularly this invention concerns the combustion of very low pressure gases which by their own pressure and velocity, are unable to aspirate sufficient air for combustion.

2. Description of the Prior Art

In the prior art, numerous examples are shown of apparatus for the combustion of gas in a furnace or combustion chamber. These generally have the gas supplied at pressures capable of gas discharge from ports at 100 feet per second or more, and thus at sufficient velocity to aspirate air with the gas to provide for the combustion of the gas. Gases of reference and at pressures of reference seldom flow at greater than 25'/second. Aspiration of air with gas is as velocity squared.

No satisfactory way has been shown for burning of very low pressure gases in furnaces, except for the method taught by this invention.

In oil refineries and petrochemical and chemical plants, there will be, in many cases, waste gases which are fuel rich, but which cannot be used as fuels, because they are available at pressures below that which will permit them to be burned in a satisfactory manner in conventional apparatus.

For various reasons, it is either impossible, or energy wasteful, to compress these gases to make them useful in typical gas burners such as are well known in the art. Gases, as fuels, typically become useful when available at pressures capable, when discharged to atmospheric pressure to produce velocities of flow, which reasonably closely approach critical, or sonic velocity, in order to meet burning requirements for gaseous fuels in the industries mentioned above.

The art will show a number of devices which make use of the discharge of a gaseous fluid, such as steam, or air for inspiration, entrainment of the fuel potential gas, to so accelerate its flow movement as to provide suitable air mixture with the steam-gas, as well as turbulence to permit satisfactory burning. However, in the prior art there is no limitation on the pressures at which the steam or air might be employed. Also the devices for aspiration and entrainment of low pressure gases are comparatively complex.

In this field of art, prior efforts to simplify the structure, or devices required, have exhibited undesirable characteristics, in one respect or another, as fuel burning is considered, although such prior devices have been placed in commercial service despite their many faults. The apparatus of this invention provides a fully satisfactory alternative to the prior art devices.

SUMMARY OF THE INVENTION

It is a primary object of this invention to provide an apparatus for use in the combustion of energy containing gases, at very low pressures.

It is a further object of this invention to provide a motive power, or energy, for the combustion of low pressure gases, which not only aspirates the gas into the combustion zone, but also serves to aspirate air for combustion, into the flame, and further provides chemical treatment to minimize the difficulty of burning in the combustion, thus promoting complete combustion of the fuel. This is a result of conversion of steam-hydrocarbon to CO and $H_2$, as is well known in the art of fuels burning.

The apparatus is applied to a conventional combustion chamber or furnace, in which there is an opening through one wall. A burner tube is provided of selected length and diameter with means to mount it axially in the opening. Along the central axis of the burner tube, or gas tube, is a smaller diameter pipe or steam tube for supplying steam. This steam tube is closed at its distant end, which is substantially in the plane of the end of the burner tube which is inserted into the opening.

At its closed end, the steam tube has a plurality of nozzles, ports, or orifices, which are drilled at a selected angle to the axis and are circumferentially spaced. When steam is applied to this steam tube, a plurality of steam jets of high velocity issue from the orifices, or ports, along the surface of a cone, of conical angle corresponding to that of the selected angle of the orifices.

At the distant end of the burner tube, which is the end which is inserted part way into the opening in the furnace wall, there is an inwardly extending flange of selected radial width. This flange serves to direct the longitudinally moving gas in the burner tube to a crowding effect and causing the gas to flow inwardly toward the axis, so as to contact the outwardly flowing jets of steam at a preferred and substantial angle, and therefore to permit more active entrainment and acceleration and mixing, of gas with the steam, to the end that a conical wall of steam and gas issues from the end of the burner tube and flows into the furnace through the central opening.

This high velocity wall of steam and gas further aspirates air through the annulus of the central opening, surrounding the burner tube, and causes the air to be entrained and turbulently mixed with the steam and gas, so as to promote complete and smokeless combustion, after ignition, by means common to the art, but not shown.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
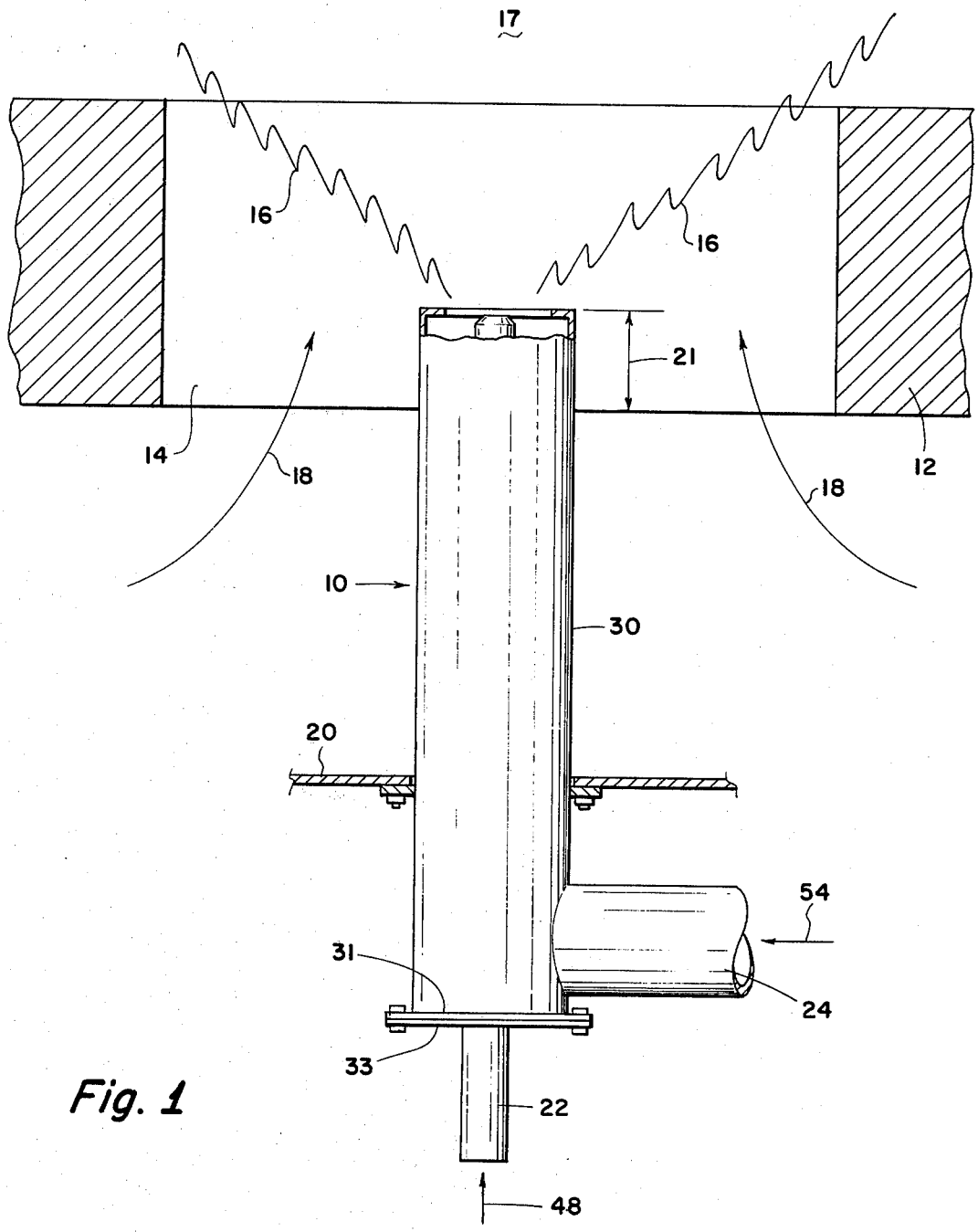
FIG. 1 illustrates the positioning of the burner in an opening through the wall of the furnace.
Figure 3:
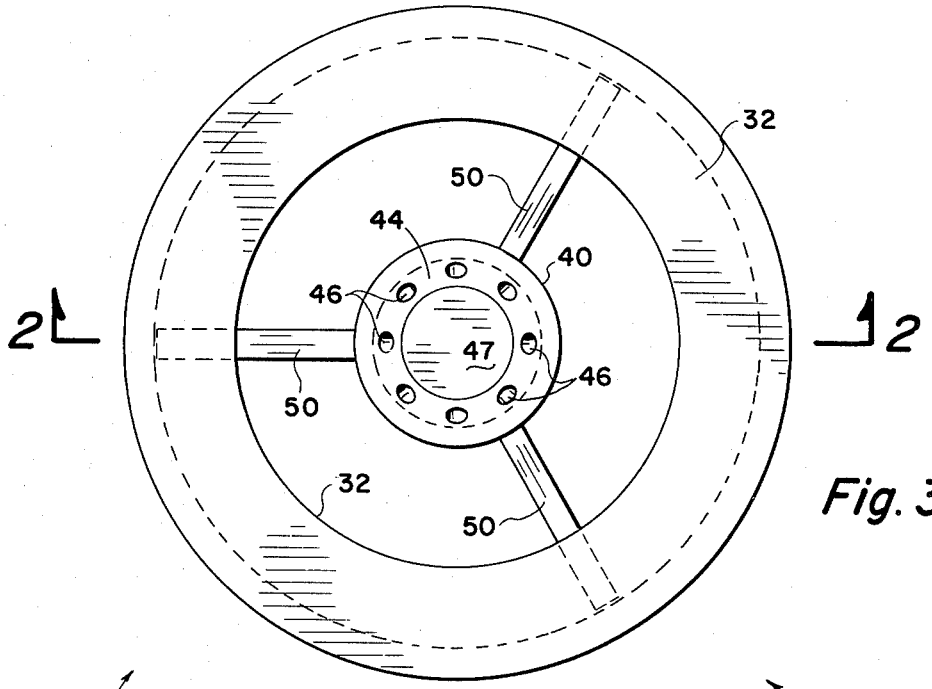
FIGS. 2 and 3 illustrate in axial section and in transverse end view, the apparatus of this invention.

Referring now to the drawings and in particular to FIG. 1 there is shown an external view of the burner 10 which is the subject of this invention. The burner 10 is inserted axially into an opening 14 in the wall 12 of a furnace or combustion chamber, where numeral 17 indicates the volume inside of the furnace. The end of the burner 10 is inserted a selected distance 21 which is a fraction of the thickness of the wall 12 of the furnace. The burner is supported in a plate 20 which is parallel to the front wall of the furnace, and provides support for the burner. The plate 20 also supplies openings, not shown, for control of the passage of combustion air 18 which will be drawn into the opening 14, by furnace draft typically.

The burner 10 comprises an outer tube 30 which forms the wall of the burner system. The distant end, which is inserted into the opening 14 is partially closed by an annular, inwardly extending, flange 32 of selected radial dimension. The inner corner of the flange is bevelled so as to cause the flow of gas, which is indicated by the arrows 52, and which is parallel to the walls and axis of the tube 30 in flow toward 32, to curve inwardly toward the axis, in accordance with arrows 56. The near end 31 of the burner tube 30 is closed by a plate 33. A side pipe 24 is attached to the burner tube 30, and is connected to the source of low pressure gas, which flows through the pipe 24 in accordance with arrow 54.

Inserted along the axis of the burner tube 30, is a steam tube 22, which passes through the plate 33, and extends substantially up to the flange 32 of the burner tube. This steam tube is supported by radial legs 50 so as to be substantially centered in the burner tube 30.

The steam tube 22 has a nozzle structure 40 attached to its distant end, which is closed. There are a plurality of orifices 46 which are drilled through the closed end at a selected angle 45 to the axis of the steam tube, and the burner tube. Steam under pressure inside of the steam tube, which flows in accordance with arrow 48 will issue from the orifices 46 as individual steam jets 46', which form a conical wall 16 of steam, as shown in FIG. 1. This conical wall is substantially at the same angle 45, to the axis, and extends further into the opening and into the space 17 of the combustion chamber.

The closed end of the nozzle 40 on the steam tube 22 is preferably turned to a conical surface 44 which is substantially perpendicular to the orifices 46. This tapered end also helps control the flow of gas to the steam jets.

In operation, the gas at very low pressure is applied in accordance with arrows 54 to the pipe which flows into the annular space 58 inside of the burner tube 30 and outside of the steam tube 22, with its nozzle structure 40. The flow of gas is longitudinal in accordance with arrows 52 except near the closed end, where the flange 32 restricts the opening of the tube 30 and causes an inward curvature 56 of the flow lines of the gas, to better intersect with the steam jets 46' which issue from the orifices 46. The steam jets entrain and accelerate the gas molecules, and cause an intimate turbulent mixture of the steam and gas in the annular opening between the flange 32 and the nozzle 40.

Figure 2:
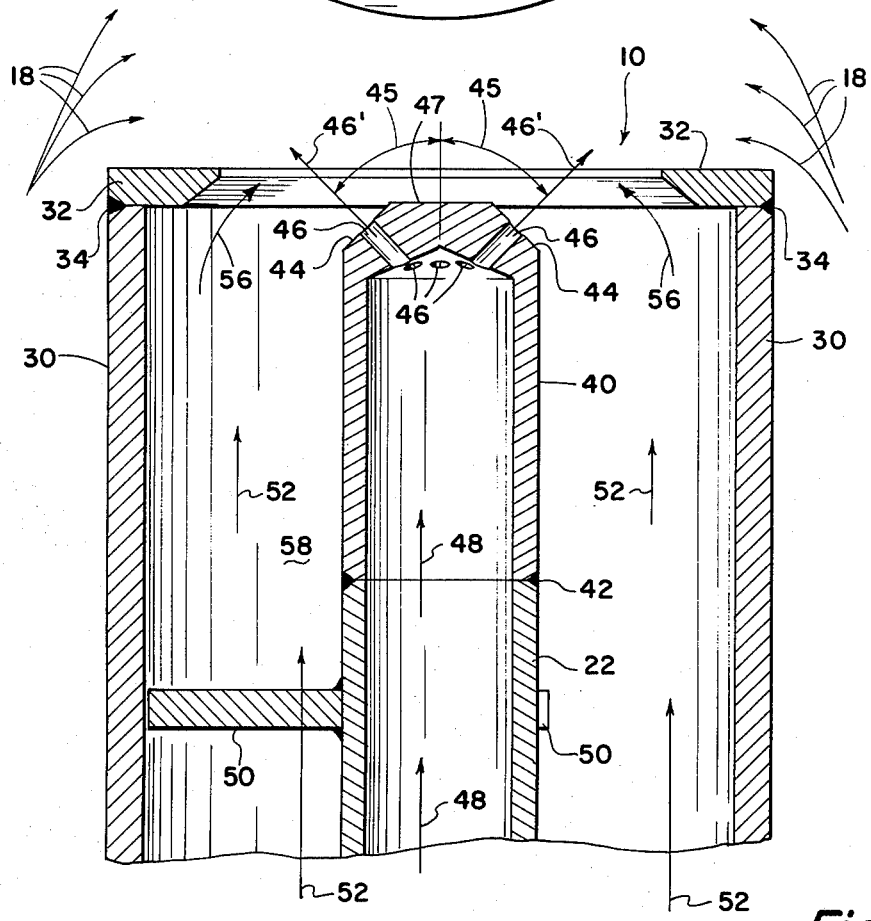

The conical surface 16, which is formed of the plurality of steam jets and entrained gas flowing through the annulus of the opening 14 in the furnace wall, causes the induction of air in accordance with arrows 18 in FIGS. 1 and 2. The air is further entrained in the high velocity conical wall of steam and gas, and thus an intimate mixture of gas and air and steam is formed, which burns rapidly and completely in a smokeless manner.

The pressure of the steam in the line 22 need not be extremely high but should preferably be at least 5 to 15 pounds gauge so that the velocity of the steam issuing from the ports 46 will be sufficiently high to entrain and aspirate the gas and the air.

The use of steam, rather than compressed air, as is common in the prior art installations for the aspiration of the gas, and to provide energy for mixing of the air and gas, is to be preferred. The reason is that the use of steam is typically simpler and ultimately less expensive than compressing air. However, another important point is that the steam not only provides the mechanical energy for aspiration, entrainment, and mixing, but it also provides premixed steam with the gas for the chemical action which assists in the process of providing complete and smokeless combustion.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. Apparatus for burning very low pressure gas which, by its pressure and velocity, is unable to aspirate air sufficient for combustion in combination with a combustion chamber, having an opening through one wall, and a source of very low pressure gas, comprising a burner axially positioned into said opening, said burner comprising;

(a) a burner tube into which the low pressure gas is supplied, the tube of selected diameter and length, and having an annular inwardly extending flange at the flame end of selected radial width, said flange beveled around its inside upstream edge, said burner tube closed at the other end, (b) a tube positioned axially inside said burner tube, said tube passing through said closed end into said burner tube and terminating with a closed end below the top of said annular flange said end machined with its outer surface conical, (c) a plurality of orifices or ports drilled into and perpendicular to said conical surface of said tube, (d) means supplying steam, at pressure of at least 5 psig, into said tube, whereby high velocity jets of steam issuing from said orifices will flow in the form of a conical wall through the annular opening in said wall into said combustion chamber, whereby said low pressure gas will turbulently mix and flow with said conical wall of steam, and thence through said opening into said combustion chamber, and whereby said flow of steam and gas will aspirate combustion air which surrounds said burner tube into said opening to mix with said steam and gas for burning.

* * * * *